United States Patent [19]

Scheffel et al.

[11] 4,136,620

[45] Jan. 30, 1979

[54] SELF STEERING RAILWAY TRUCK

[75] Inventors: Herbert Scheffel, Pretoria; Rowlen E. von Gericke, Kempton Park, both of South Africa

[73] Assignee: South African Inventions Development Corporation, Pretoria, South Africa

[21] Appl. No.: 701,775

[22] Filed: Jul. 2, 1976

[30] Foreign Application Priority Data

Jul. 14, 1975 [ZA] South Africa ..... 75/4505

[51] Int. Cl.[2] ..... B61F 3/08; B61F 5/06; B61F 5/32; B61F 5/38

[52] U.S. Cl. ..... 105/168; 105/176; 105/182 R; 105/199 S; 105/224.1; 267/3

[58] Field of Search ..... 105/167, 168, 165, 180, 105/182 R, 197 A, 199 CB, 224 R, 224.1, 222, 223, 199 S, 176; 267/3, 152, 153, 63 A; 308/138; 295/34 R

[56] References Cited

U.S. PATENT DOCUMENTS

| | | | |
|---|---|---|---|
| 986,185 | 3/1911 | Lincoln | 105/165 |
| 1,293,628 | 2/1919 | Coda | 295/34 |
| 1,941,159 | 12/1933 | Tatum | 105/222 |
| 2,229,429 | 1/1941 | Travilla, Jr. | 105/222 |
| 3,302,589 | 2/1967 | Williams | 105/222 |
| 3,380,400 | 4/1968 | Barber | 105/224.1 X |
| 3,434,708 | 3/1969 | Hawk, Jr. | 267/153 X |
| 3,464,366 | 9/1969 | Seay | 267/3 X |
| 3,528,374 | 9/1970 | Wickens | 105/165 X |
| 3,539,170 | 11/1970 | Hamel | 267/63 A |
| 3,575,403 | 4/1971 | Hamel et al. | 105/197 A X |
| 3,626,465 | 12/1971 | Hirst | 105/224.1 |
| 3,895,586 | 7/1975 | Willetts | 105/224.1 |
| 3,915,520 | 10/1975 | Hassenauer | 308/138 |
| 4,026,217 | 5/1977 | Cross et al. | 105/224.1 |
| 4,067,261 | 1/1978 | Scheffel | 105/182 R X |
| 4,067,262 | 1/1978 | Scheffel | 105/182 R X |

FOREIGN PATENT DOCUMENTS

| | | | |
|---|---|---|---|
| 1250546 | 12/1960 | France | 105/167 |
| 2163 of | 1879 | United Kingdom | 105/224.1 |

OTHER PUBLICATIONS

Wickens, A. H.; The Dynamics of Railway Vehicles on Straight Track: Fundamental Considerations of Lateral Stability, Jun. 1, 1965, pp. 1-16 inc.

Wickens, A. H.; General Aspects of the Lateral Dynamics of Railway Vehicles; Dec. 5, 1968, Paper No. 68-WA/RR-3; pp. 1-7 inc. Transaction of the ASME Journal of Engineering for Industry.

Wickens, A. H.; Recent Developments in the Lateral Dynamics of High Speed Railway Vehicles; Dec. 1967, Monthly Bulletin of the International Railway Congress Association, vol. XLIV, No. 12; pp. 781-803 inc.

*Primary Examiner*—Albert J. Makay
*Assistant Examiner*—Howard Beltran
*Attorney, Agent, or Firm*—Ladas, Parry, Von Gehr, Goldsmith & Deschamps

[57] ABSTRACT

A load-carrying railway truck having a longitudinal axis in its direction of travel and including at least one load-bearing member for supporting a load; a pair of live wheelsets supporting the load-bearing member, each wheelset being so mounted in the truck and having such a profile that it is substantially self-steering; means interconnecting the wheelsets to transmit yawing and lateral movements of either wheelset in the opposite sense to the other wheelset; and elastic elements suspending the load to the wheelsets, at least some of the elastic elements having a lateral stiffness in a direction transverse to the longitudinal axis of the truck which is lower than the stiffness provided by them in a direction parallel to the longitudinal axis.

7 Claims, 10 Drawing Figures

SELF STEERING RAILWAY TRUCK

CROSS-REFERENCE TO RELATED APPLICATION

This application is related to Ser. No. 702,304, July 2, 1976, U.S. Pat. No. 4,067,261, issued Jan. 10, 1978, which is a continuation-in-part of Ser. No. 415,232, filed Nov. 12, 1973, abandoned, and a continuation-in-part of Ser. No. 565,888, Apr. 7, 1975, U.S. Pat. No. 4,067,262, issued Jan. 10, 1978.

This invention relates to railway vehicles and in particular to suspensions for such vehicles. The invention is applicable to railway vehicles in which a body is pivotally mounted on bogies (trucks) and to railway vehicles in which a body is directly supported on a pair of wheelsets, i.e. a Four-Wheeler.

This specification defines the term "railway truck" to mean a basic railway vehicle including a load-bearing structure supported on at least two "live" wheelsets. Thus a railway truck may be a bogie or a Four-Wheeler with the "load-bearing structure" being one of the frame members in the event of a bogie and being the body in the event of a Four-Wheeler.

It has already been proposed to provide a railway truck having a good curving ability simultaneously with a high hunting stability, the truck being characterised by having self-steering wheelsets and by means directly interconnecting the wheelsets to transmit yawing and lateral movements of either wheelset in opposite sense to the other wheelset. The interconnecting means serves to counteract hunting of the wheelsets without interferring with the natural self-steering ability of the wheelsets. The wheelsets are made to be self-steering by providing them with profiled or concave treads and by elastically suspending them to the load-bearing structure(s) by means which impose a constraint against yawing which is lower than the steering forces generated on the wheelsets on curved track.

It is an object of the invention further to improve the operating characteristics of a railway truck of the type discussed above.

In a load-carrying railway truck having a longitudinal axis in its direction of travel and including a load-bearing structure for supporting a load; a pair of wheelsets supporting the load-bearing structure through axle bearings on each wheelset, adaptor means on each axle bearing and at least one elastic element between each adaptor means and the load-bearing structure, the wheelsets each being substantially self-steering; and means interconnecting the wheelsets to transmit yawing and lateral movements of either wheelset in opposite sense to the other wheelset, the invention provides the improvement that the elastic elements provide a lateral stiffness in a direction transverse to the longitudinal axis of the truck which is lower than the stiffness provided by them in a direction parallel to the longitudinal axis.

Tests have shown that providing such elastic elements serve to make the vehicle more stable with respect to body hunting instabilities than was heretofore obtained. Tests have also shown that it is essential for the wheelsets to be interconnected so that their turning movements are coupled in opposite senses as this counteracts hunting of the wheelset and provides a railway truck in which such elastic elements as mentioned above may be incorporated into the suspension without adversely affecting or further decreasing the hunting stability of the wheelset.

The elastic elements may include any known form of resilient element, e.g. rubber blocks, rubber sandwich elements comprising alternate layers of rubber and metal plate, or coil springs.

Preferably the elastic element comprises a cylindrical member interposed between an upper or lower surface of a resilient member and a corresponding part of the truck supporting or supported on the resilient member, the cylindrical member being formed with an arcuate surface and being arranged in the truck to have its axis of rotation parallel to the longitudinal axis of the truck. Conveniently the cylindrical member is a segment of a circle in cross-section.

The arcuate surface of the cylindrical segment may abut a planar surface or may abut a cylindrical concave surface of greater radius than that of the cylindrical segment.

preferably the lateral stiffness is between 25 and 75 % of the longitudinal stiffness and, optimally, is in the range from 33 ⅓to 50% of the longitudinal stiffness.

The invention is further discussed with reference to the accompanying drawings in which the same or similar parts have the same reference numerals and in which.

Figure 1:
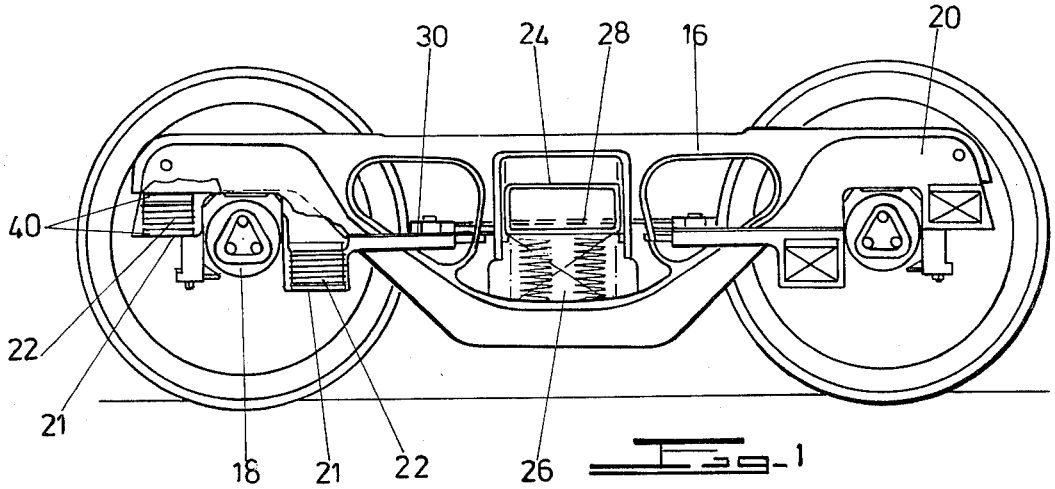
FIG. 1 shows a side view of a bogie of the invention, parts being broken away for clarity.
Figure 2:
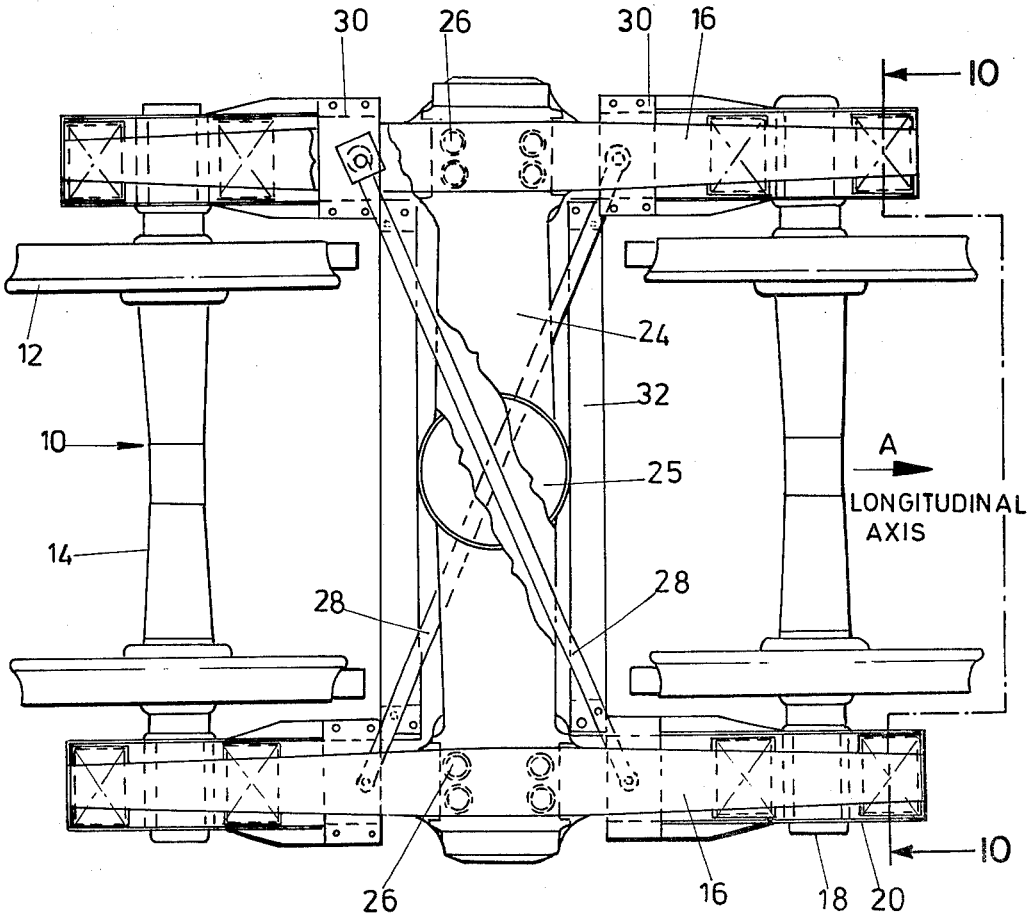
FIG. 2 shows a plan view of the embodiment of FIG. 1.

FIGS. 1 and 2 show a three-piece bogie comprising a pair of live wheelsets 10 each with a pair of wheels 12 fast on an axle 14, the wheels having profiled treads, bearings 18 towards each end of each axle 14, adaptors 20 supported on the bearings, elastic elements 22 supported on horizontal flanges 21 of the adaptors 20, and side frames 16 supported on the elastic elements 22. A bolster 24 is resiliently supported on the side-frames 16 through coil springs 26. A conventional female wear-plate 25 is provided centrally on the bolster for pivotally mounting a superstructure or body on the bogie.

The wheelsets 10 are interconnected to couple their turning or yawing movements in opposite senses by anchors 28 that extend diagonally across the bogie and are pivotally secured at their ends to extensions 30 secured to the adaptors 20, the extensions 30 on each wheelset being connected by a beam 32 to form a sub-frame on that wheelset.

Figure 3:
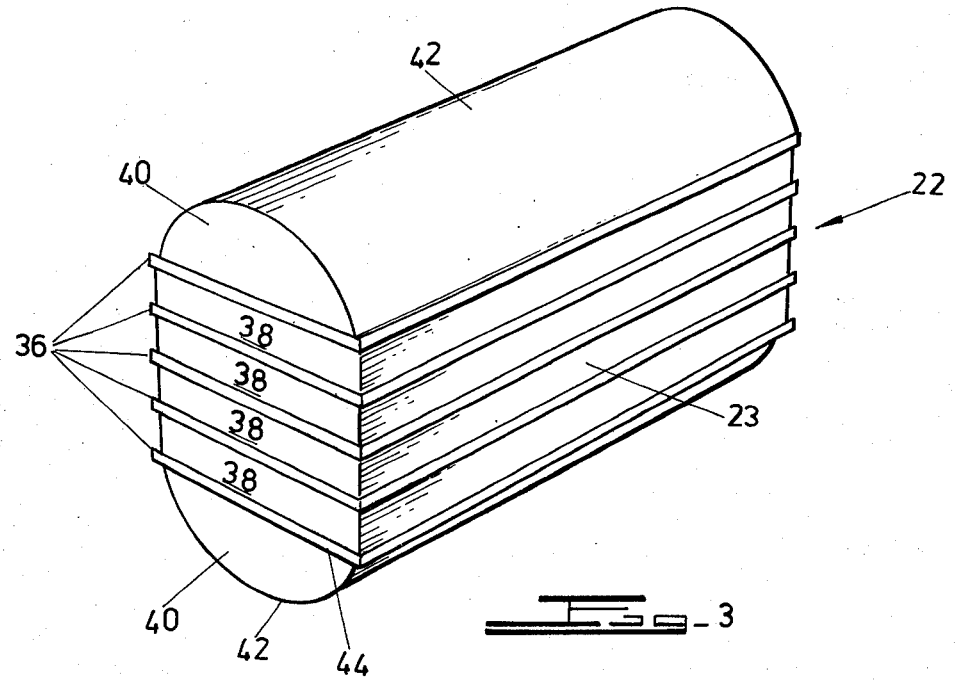
FIG. 3 shows, on an enlarged scale, an elastic element used in the bogie of FIGS. 1 and 2.

An elastic element 22 is shown in greater detail in FIG. 3 and comprises a sandwich of alternate layers of metal plate 36 and rubber 38 forming an elongate block.

On the upper and lower surfaces of the sandwich are mounted cylindrical segments 40 having an arcuate surface 42 and a plane surface 44, the plane surface being bonded to the rubber sandwich. The axis of the cylindrical segment 40 is aligned parallel to the longitudinal axis of the truck which is denoted A in FIG. 2. The segments 40 may be of metal or may be of an elastic material. The elongate shape of the sandwich makes its lateral stiffness lower than its longitudinal stiffness and this is further modified by the segments 40.

The elastic elements 22 have a longitudinal stiffness which, in combination with the wheel-tread profile makes each wheel-set substantially self-steering in the curves of the system in which the bogie is to be used. The aforementioned U.S. application Ser. No. 702,304, filed July 2, 1976, of Herbert Scheffel discloses the relationship between longitudinal stiffness and wheel-tread profile necessary to obtain self-steering and is hereby specifically incorporated in this specification by reference. A lateral stiffness for each element 22 which is about one third to one half its longitudinal stiffness has been found to stabilize body-hunting instabilities effectively. With the construction shown in the drawings, the elements 22 can rock about an axis parallel to the longitudinal axis of the bogie; tests have shown that this further improves body-hunting stability.

Figure 4:
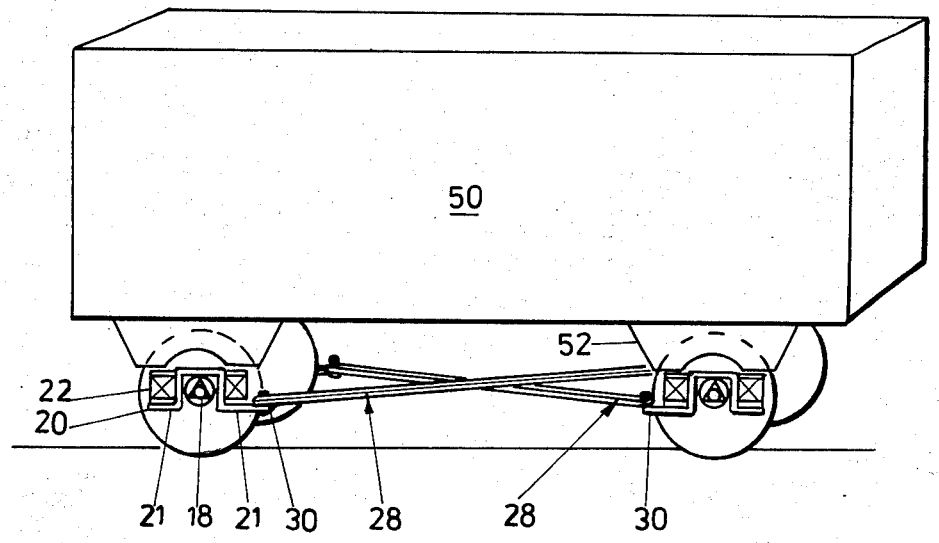
FIG. 4 shows a schematic perspective view of a Four-Wheeler of the invention.

FIG. 4 shows schematically a side view of a Four-Wheeler of the invention which includes a body 50 for carrying a load, the body being directly supported on the wheelsets 10 through bearings 18, adaptors 20 and elastic elements 22 as discussed previously. A bridge-shaped supporting member 52 is provided on the body 50 to mount it on the elastic elements 22. The wheelsets are interconnected by anchors 28 to couple their yawing movements in opposite senses.

Figure 5:
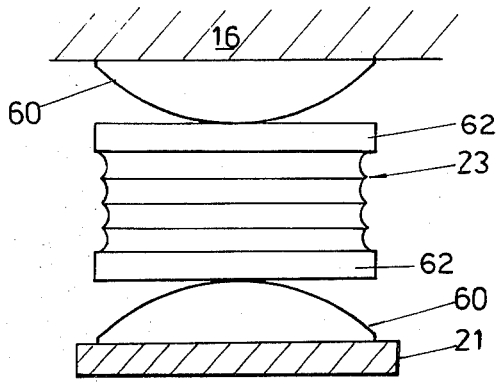
FIG. 5 shows an end view along the longitudinal axis of the truck of a variant of an elastic element having a lower lateral than longitudinal stiffness.
Figure 6:
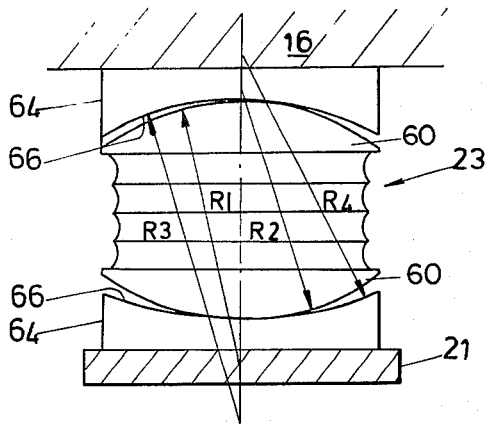
FIG. 6 shows a further variant of elastic element.
Figure 7:
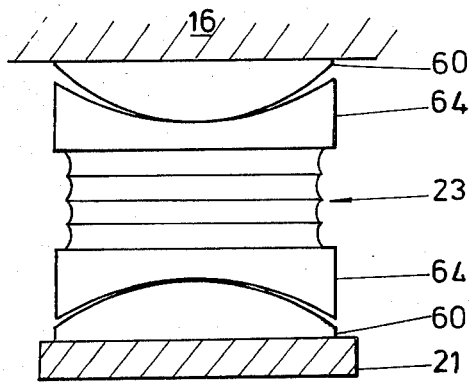
FIG. 7 shows a further variant of elastic element.

FIGS. 5 to 7 show different embodiments of elastic elements modified to have a lower lateral than longitudinal stiffness. For simplicity in all embodiments the element is shown positioned between a flange 21 of an adaptor 20 and a part of a side-frame 16 of a bogie.

In FIG. 5, segments 60 of a round cylinder are each secured to the flange 21 and side-frames 16 with their arcuate surfaces facing outwardly. These outer arcuate surfaces abut planar end-plates 62 that are bonded to a sandwich type resilient member 23.

In FIG. 6 an elastic element of the type shown in FIG. 3 is shown and comprises an elastomeric sandwich element 23 having segments 60 of a round cylinder bonded to its upper and lower surfaces. Members 64 which are formed with concave cylindrical surfaces 66 are secured to the flange 21 and side-frame 16. The radii of the surfaces 66 are greater than the radii of the segments 60.

FIG. 7 shows an arrangement which is similar to that of FIG. 6, but with the segments 60 and members 64 reversed.

Figure 8:
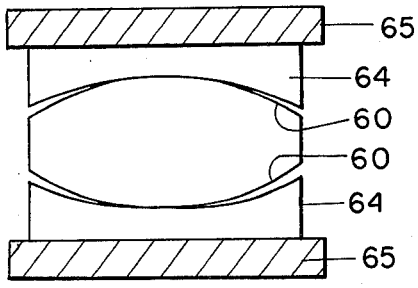
FIG. 8 shows a device for use with a resilient member to provide a lower lateral than longitudinal stiffness for the resilient member.

FIG. 8 shows a device including two integral segments 60 which are formed from a solid metallic body, concave cylindrical members 64 having a greater radius of curvature than the segments 60, and mounting plates 65. This device is used in conjunction with an elastomeric or other resilient element, e.g. a coil spring either above or below it, to decrease its lateral stiffness.

Figure 9:
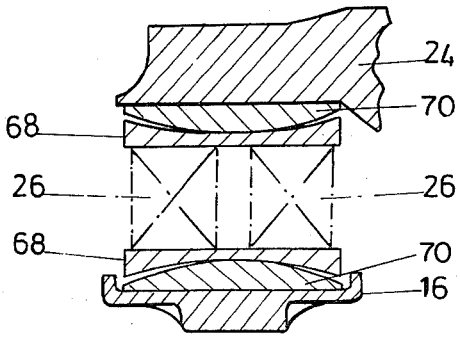
FIG. 9 shows a view along to the longitudinal axis of the truck through an elastic element having a lower lateral than longitudinal stiffness for suspending a bolster on the side-frame of a three-piece bogie.
Figure 10:
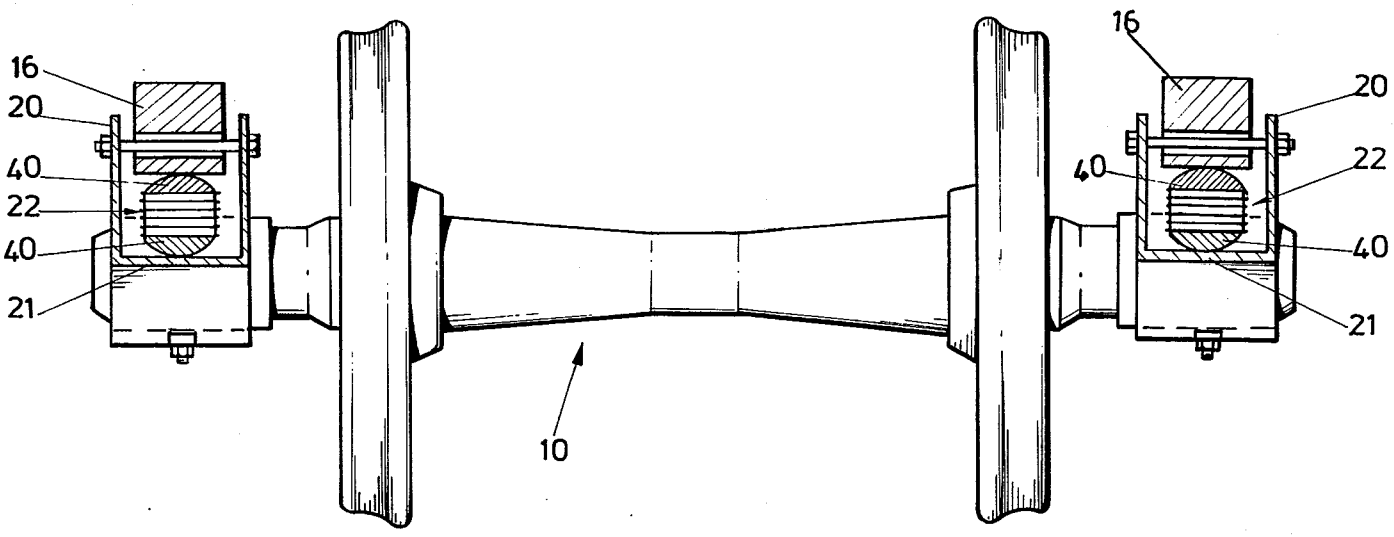
FIG. 10 is an end elevation view of the truck shown in FIGS. 1 and 2 taken along the section line 10—10 in FIG. 2.

FIG. 9 shows how the coil springs 26 which resiliently mount a bolster 24 on a side-frame 16 are modified to have a lower lateral than longitudinal stiffness. In this event a plate 68 which has a concave surface is provided at either end of and spans two coil springs 26. Cylindrical segments 70 are secured to the bolster 24 and side-frame 16 and ride in the concavities of the plates 68.

While not shown, in some railway vehicles such as passenger vehicles the body or coach is resiliently mounted on the bolster 24 of a bogie. In this event, these elastic elements can be made to have a lower lateral than longitudinal stiffness as discussed above.

The embodiments shown in FIGS. 3 and 5 to 9 of the drawings are merely exemplorary of the constructions which can be used to obtain a lower lateral than longitudinal stiffness for the elastic elements in a railway vehicle and, as will be appreciated, there are many other variants and simplifications which may be employed. For example a cylindrical segment can be employed at only the upper or the lower surface of a resilient element. Furthermore the positioning of the cylindrical segments and concavities can be interchanged without effecting their performance.

As will be appreciated, the amount by which the cylindrical segments will lower the lateral stiffness of a resilient element will depend on the radius of curvature of the cylinder and the radius, if employed, of the cylindrical concavity used with the segment. They will have least effect when the radius is large and most effect when the radius is small. The limiting case of a large radius is when the radius is infinite in which event the segment will be flat and will have no effect whatsoever. The cylindrical concavity decreases the effect of the radius of the segment. Thus by selecting the correct radii any desired lowering of the lateral stiffness can be obtained. The radii of the segments and of the concavities need not be the same, i.e. referring to FIG. 6 the radii R1 and R2 can be different and the radii R3 and R4 can be different.

The cylindrical segments 60 as illustrated in the drawings are free to move laterally. These segments, however, are fixed so that they cannot slide longitudinally. As will be appreciated this is essential for the elastic elements to be effective longitudinally. Since any convenient flanges or stops may be used to prevent the segments 60 from sliding and no skill is required to design such stops these have not been shown or described.

We claim:

1. A load-carrying railway truck having a longitudinal axis in its direction of travel and including a load-bearing structure; a pair of live-axle wheelsets each comprising a pair of wheels solidly mounted on an axle and supporting the load-bearing structure through axle bearings mounted on each axle, load-transmitting means for each axle bearing including an adaptor means seated on the bearing and having flanges straddling the bearing, and an elastic element between each adaptor flange and the load-bearing structure, with each wheel tread being profiled to a high effective conicity to generate steering forces by the conical tread independently of the wheel flange and the elastic elements providing constraints against longitudinal movement of each wheelset with respect to the load-bearing structure which are lower than the steering forces whereby each wheelset is substantially self-steering; and means interconnecting the wheelsets to couple yawing movements of each wheelset in opposite sense to the other wheelset, the interconnecting means comprising a first extension secured to an adaptor on the first wheelset, an identical extension being secured to a diagonally opposite adaptor on the second wheelset, an anchor means extending diagonally across the truck pivotally connected to the free ends of the first and second extensions; each of the elastic elements comprising a first member resilient in the lateral and longitudinal directions of the truck and an elongate second member having an arcuate surface in vertical load supporting engagement with the first member, each elastic element being disposed on an adaptor flange with the principal axis of the second member parallel to the longitudinal axis of the truck whereby each elastic element provides a resilient constraint in a direction transverse to the longitudinal axis of the truck which is lower than the resilient constraint in a direction parallel to the longitudinal axis of the truck.

2. A truck as claimed in claim 1, in which the arcuate surface of the second member faces the resilient member.

3. A truck as claimed in claim 1, in which the arcuate surface of the second member faces away from the resilient member.

4. A truck as claimed in claim 1, in which the arcuate surface of the second member abuts a planar surface.

5. A truck as claimed in claim 1, in which there are second member above and below the resilient member.

6. A truck as claimed in claim 1, in which said second member is in the form of a cylindrical segment having its axis parallel to the longitudinal axis of the truck.

7. A truck as claimed in claim 6, in which the arcuate surface of the cylindrical segment abuts a cylindrical concave surface of greater radius of curvature than that of the arcuate surface, the axis of the concave cylindrical surface being aligned parallel to the longitudinal axis of the truck.

* * * * *